US007156817B1

(12) United States Patent
Cassidy Phillips

(10) Patent No.: US 7,156,817 B1
(45) Date of Patent: Jan. 2, 2007

(54) MASSAGE BALL

(76) Inventor: Peter L. Cassidy Phillips, 1136 Whitshire Way, Alpharetta, GA (US) 30004

( * ) Notice: Subject to any disclaimer, the term of this patent is extended or adjusted under 35 U.S.C. 154(b) by 217 days.

(21) Appl. No.: 10/419,460

(22) Filed: Apr. 21, 2003

Related U.S. Application Data

(60) Provisional application No. 60/378,186, filed on May 3, 2002.

(51) Int. Cl.
*A61H 15/00* (2006.01)

(52) U.S. Cl. ..... 601/131; 601/134; 601/136

(58) Field of Classification Search ..... 601/23, 601/27, 40, 131, 133–137; 482/22, 44, 45, 482/47, 49, 91; 473/364, 367, 368, 373, 473/374, 376–378; 273/153 S
See application file for complete search history.

(56) References Cited

U.S. PATENT DOCUMENTS

| | | | | |
|---|---|---|---|---|
| 744,718 | A | 11/1903 | Cassidy | |
| 2,229,170 | A * | 1/1941 | Greene | 473/354 |
| 2,258,333 | A * | 10/1941 | Miller | 473/364 |
| 5,407,998 | A * | 4/1995 | Horiuchi et al. | 473/378 |
| D403,076 | S | 12/1998 | York | D24/214 |
| 5,868,689 | A | 2/1999 | Faroky et al. | 601/120 |
| 6,093,159 | A | 7/2000 | Racoosin | 601/131 |
| 6,146,343 | A | 11/2000 | Stewart | 601/118 |
| 6,210,304 | B1 * | 4/2001 | Scatterday | 482/49 |
| 6,241,696 | B1 | 6/2001 | York | 601/137 |
| 6,267,695 | B1 * | 7/2001 | Masutani | 473/371 |
| 6,638,184 | B1 * | 10/2003 | Nesbitt et al. | 473/372 |
| 6,645,089 | B1 * | 11/2003 | Tsunoda et al. | 473/364 |
| 6,712,716 | B1 * | 3/2004 | Halko | 473/362 |
| 6,784,127 | B1 * | 8/2004 | Yamakawa et al. | 442/409 |

FOREIGN PATENT DOCUMENTS

JP 411239594 A * 9/1999

OTHER PUBLICATIONS

Resin, Synthetic, Hawley's Condensed Chemical Dictionary, 14th Edition.*

* cited by examiner

*Primary Examiner*—Quang D. Thanh
(74) *Attorney, Agent, or Firm*—R. Keith Harrison

(57) ABSTRACT

A multi-layered massage ball which substantially mirrors the hardness and deformation characteristics of the human thumb and is particularly effective in relieving tender and painful muscle conditions, including but not limited to trigger points. The massage ball typically includes a core, at least one resilient layer encapsulating the core, and a ball cover. The massage ball may be pressed and rolled against the afflicted area or areas to substantially alleviate pain and discomfort associated with muscle or connective tissue conditions.

3 Claims, 1 Drawing Sheet

MASSAGE BALL

CROSS-REFERENCE TO RELATED APPLICATIONS

This application claims the benefit of provisional application No. 60/378,186, filed May 3, 2002.

FIELD OF THE INVENTION

The present invention relates to therapeutic body massage devices, and more particularly, to a multi-layered massage ball which substantially mirrors the hardness and deformation characteristics of the human thumb or flesh and is particularly effective in relieving tender and painful conditions such as muscle conditions, including but not limited to trigger points.

BACKGROUND OF THE INVENTION

The art of massage has long been used to relieve various muscle, tendon and other connective tissue ailments. The kneading of muscles, for example, imparts a modification to the muscle tissue that acts beneficially on the nerves, the muscles being controlled by the nerves in both their movement and nourishment, health of the muscle tissue due to improved blood circulation, and effusion of waste material from the muscle and connective tissues. Accordingly, numerous devices are known in the art for massaging muscles or other tissues. Patents of interest in this regard include U.S. Pat. Nos. 744,718; 5,868,689; 6,093,159; 6,146,343; 6,241,696; and Des. Pat. No. 403,076;

A "trigger point" is a common type of connective tissue injury which may be caused by conditions including but not limited to long periods of sitting, repetition of movement, poor biomechanics, myofacia accumulation, electrolyte depletion, salt deficiency, or general muscle over-use. A trigger point is a discrete knot or tight, ropy band of muscle that forms when a muscle fails to relax. The knot often can be felt under the skin and may twitch involuntarily when touched. This is known as a "jump sign". Trigger points can trap or irritate nerves surrounding the affected tissue and cause referred pain—pain which originates in one part of the body and is felt in another (such as pain from a heart attack that is felt in the jaw or arm). Scar tissue, loss of range of motion and muscle weakness may occur over time as a result of a trigger point. Accordingly, a new and improved message ball is needed which is particularly effective in relieving pain and discomfort associated with trigger points as well as other muscle or connective tissue ailments. A massage ball is needed which mirrors the hardness and deformation characteristics of the flesh on the human thumb or palm, is effective in creating elasticity in the belly of muscle tissue and is capable of hands-free use by physically handicapped or debilitated persons.

SUMMARY OF THE INVENTION

The present invention is generally directed to a multi-layered massage ball which substantially mirrors the hardness and deformation characteristics of the human thumb and is particularly effective in relieving tender and painful muscle conditions, including but not limited to trigger points. The massage ball typically includes a core, at least one resilient layer encapsulating the core, and a ball cover. The massage ball may be pressed and rolled against the afflicted area or areas to substantially alleviate pain and discomfort associated with muscle or connective tissue conditions.

BRIEF DESCRIPTION OF THE DRAWINGS

The invention will be better understood, by way of example, with reference to the accompanying drawings, in which.

DESCRIPTION OF THE PREFERRED EMBODIMENTS

Figure 1:
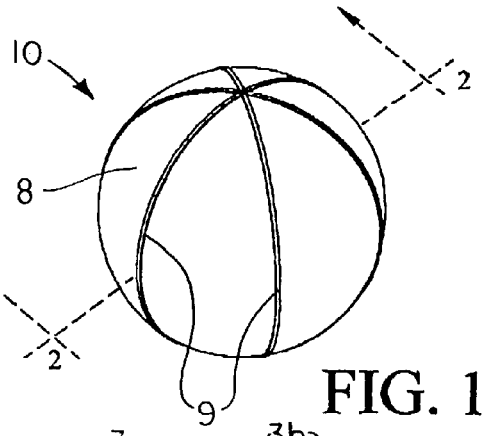
FIG. 1 is a perspective view of an illustrative embodiment of the massage ball of the present invention.
Figure 2:
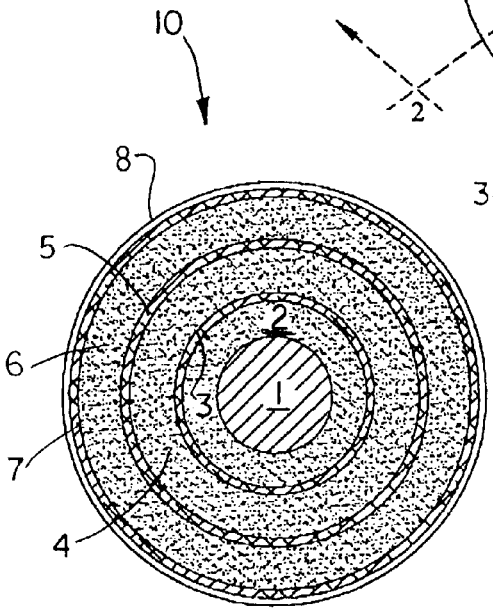
FIG. 2 is a cross-sectional view, taken along section lines 2—2 in FIG. 1.
Figure 2A:
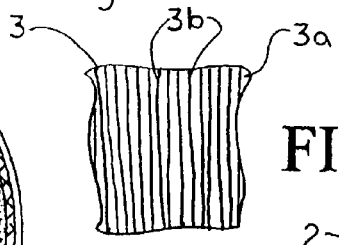
FIG. 2A is a top view of an elastic layer, partially in section, of the massage ball.

Referring initially to FIGS. 1–2A of the drawings, an illustrative embodiment of the massage ball of the present invention is generally indicated by reference numeral 10. Briefly, as shown in FIG. 2, the massage ball 10 includes a spherical core 1; a core cover 2; an inner elastic layer 3; an inner compressive layer 4; a middle elastic layer 5; an outer compressive layer 6; an outer elastic layer 7; and a ball cover 8, respectively. These layers impart compression-resistance and deformation characteristics to the massage ball 10 which mirror the compression-resistance and deformation characteristics of the flesh on a human thumb or palm. These characteristics enable the massage ball 10 to function in the same manner as the fingers or hand of a massage therapist in the treatment of muscular or other connective tissue ailments. The massage ball 10 is effective in relieving pain and discomfort associated with a variety of muscle and connective tissue ailments, and may further be used as a tool for the prevention of trigger points and other muscular and connective tissue ailments.

Figure 2C:
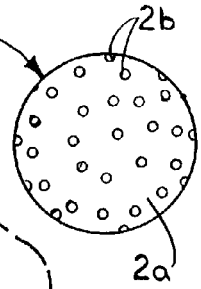
FIG. 2C is a front view of a core cover having multiple dimples therein in a typical embodiment of the invention.
Figure 2B:
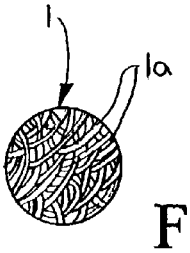
FIG. 2B is a front view of a core including multiple rubber bands wound around each other in one embodiment of the invention.

As shown in FIG. 2, the spherical core 1 of the massage ball 10 may be solid polyvinylchloride (PVC), for example. Alternatively, the core 1 may be a golf ball or may be any substantially firm, rigid, generally solid material including wood, polyurethane, stone, rubber, plastic or metal, in non-exclusive particular. As shown in FIG. 2B, still further in the alternative, the core 1 may include multiple rubber bands 1*a* tightly wrapped or wound around each other. Typically, the core 1 has a diameter of about 3.5 centimeters wide. The core 1 mirrors the firm or rigid consistency of the bone in the human thumb. The substantially firm or rigid core 1 further functions as a support base which renders the massage ball 10 capable of supporting a substantial compressive load or pressure without excessive deformation, and imparts necessary weight to the massage ball 10.

The core cover 2, which may be surlyn, for example, or other substantially rigid plastic material encircles or encapsulates the core 1 and has a thickness of typically about 3 mm. The core cover 2 typically has dimensions of about 5.5 inches×5.5 inches and is wrapped around the core 1. As shown in FIG. 2C, the outer surface 2*a* of the core cover 2 may have multiple dimples 2*b* to facilitate gripping of the adjacent, typically self-adherent inner elastic layer 3, which encapsulates the core cover 2 as hereinafter described.

The inner elastic layer 3 is typically any type of self-adherent wrap having an elastic memory, such as, for example, elastic gauze including natural rubber latex. As shown in FIG. 2A, the inner elastic layer 3 typically includes a laminate of non-woven material 3*a* having multiple, parallel elastic fibers 3*b* extending through the non-woven material 3*a*. The elastic fibers 3*b* may be natural rubber latex, for example. In a typical embodiment, the inner elastic layer 3 is COBAN (trademark), available from the 3M corporation, although other types of elastic non-woven material 3*a* including the typically latex elastic fibers 3*b* may be used instead. Typically, the inner elastic layer 3 has a thickness of about 1 mm and may be applied over the core cover 2 as a sheet having dimensions of about 5.5 inches×5.5 inches. The self-adhesive characteristic of the inner elastic layer 3 causes the inner elastic layer 3 to partially grip both the outer surface of the core cover 2 and the inner surface of the inner compressive layer 4, which surrounds or encapsulates the inner elastic layer 3 as hereinafter described. This prevents excessive sliding between the core cover 2 and the inner compressive layer 4 during use of the massage ball 10, as hereinafter described. The inner elastic layer 3 functionally corresponds to the fascia which surrounds the bone in a human thumb.

As heretofore stated, the inner compressive layer 4 surrounds or encapsulates the inner elastic layer 3. The inner compressive layer 4 may be an elastic bandage fabric such as a cotton twill fabric, an ACE (trademark) bandage, a jersey knit material, a knit cotton fabric or elastic gauze, in non-exclusive particular. The inner compressive layer 4 has a thickness of typically about 6 mm and covers the entire circumference of the inner elastic layer 3, and may be applied over the inner elastic layer 3 as a sheet having dimensions of typically about 6.9 inches×6.9 inches. The inner compressive layer 4, in combination with the outer compressive layer 6 to be hereinafter further described, imparts to the massage ball 10 compression-resistance, deformation and density characteristics which mirror those of the human thumb.

The middle elastic layer 5 surrounds or encapsulates the inner compressive layer 4. The middle elastic layer 5 is typically the same materially as the inner elastic layer 3, typically an elastic, self-adherent wrap such as elastic gauze, for example, and including a laminate of non-woven material 3*a* having multiple, parallel elastic fibers 3*b*, typically natural rubber latex, extending through the non-woven material 3*a*, as heretofore described with respect to FIG. 2A. The middle elastic layer 5 corresponds in function to the fascia which surrounds human muscle. An example of a suitable material for the middle elastic layer 5 is COBAN (trademark), available from the 3M corporation. Like the inner elastic layer 3, the middle elastic layer 5 has a thickness of typically about 1 mm. The middle elastic layer 5 may be applied over the inner compressive layer 4 as a sheet having dimensions of typically about 6.10 inches×6.10 inches. The self-adhesive nature of the middle elastic layer 5 causes it to grip the outer surface of the inner compressive layer 4, which is encapsulated by the middle elastic layer 5, and the inner surface of the outer compressive layer 6, which encapsulates the middle elastic layer 5, thus preventing excessive sliding between the inner compressive layer 4 and the outer compressive layer 6 during use of the massage ball 10, hereinafter described.

The outer compressive layer 6 encapsulates the middle elastic layer 5 and may be materially the same as the inner compressive layer 4, typically an elastic bandage fabric such as a cotton twill fabric, an ACE (trademark) bandage, a jersey knit material, a knit cotton fabric or elastic gauze, in non-exclusive particular. The outer compressive layer 6 has a thickness of typically about 5 mm and covers the entire circumference of the middle elastic layer 5, and may be applied over the middle elastic layer 5 as a sheet having dimensions of typically about 8.3 inches×8.3 inches. As heretofore noted, the outer compressive layer 6 and the inner compressive layer 4, in combination, impart to the massage ball 10 the density, compression dynamics and deformation characteristics which mirror those of the human thumb. Accordingly, the inner compressive layer 4 and the outer compressive layer 6 permit a deformation of the massage ball 10 on the order of typically about 1–3 cm in approximately 5–7 seconds. This imparts hardness, deformation and memory characteristics which mirrors those characteristics of the flesh on the human thumb or palm, for example.

The outer elastic layer 7, which is typically about 1 mm thick, encapsulates the outer compressive layer 6. The outer elastic layer 7 may be the same materially as the inner elastic layer 3 and the middle elastic layer 5, typically a self-adherent elastic wrap such as elastic gauze, for example, and including a laminate of non-woven material 3*a* having multiple, parallel elastic fibers 3*b* typically of natural latex rubber extending through the non-woven material 3*a*, as heretofore described with respect to FIG. 2A. Typically, the outer elastic layer 7 is COBAN (trademark), available from the 3M corporation. The outer elastic layer 7 mirrors the hardness and compression characteristics of the human thumb.

A ball cover 8 encapsulates the outer elastic layer 7 and may have any selected design, such as stripes 9, for example, as shown in FIG. 1. The ball cover 8 may be a polyethylene/cotton knit, combed cotton fabric, rubber, latex, lycra, polylycra, rib knit fabric, canvas, pleather or leather, in non-exclusive particular. Typically, the ball cover 8 has a thickness of about 1 mm and is applied over the outer compression layer 6 as a sheet having dimensions of about 8.5 inches×8.5 inches.

Figure 3:
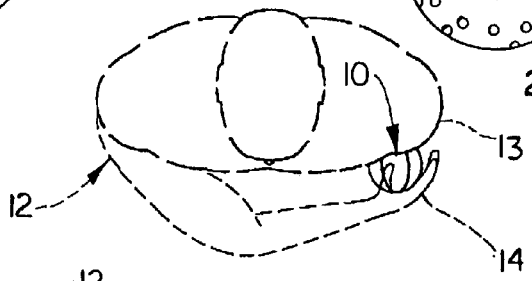
FIG. 3 is a top view of a person using the massage ball of the present invention, with the user pressing and rolling the massage ball against the user's left shoulder.
Figure 4:
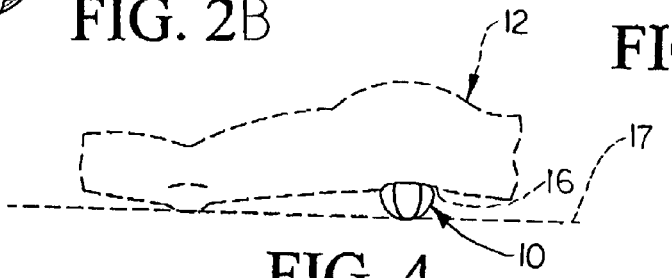
FIG. 4 is a side view of a person, partially in section, using the massage ball, more particularly illustrating an alternative manner of use in which the massage ball is interposed and rolled between a hard surface and an afflicted pelvic area, as one of multiple examples of using the massage ball.

Referring next to FIGS. 3 and 4, in typical application the massage ball 10 is used to relieve pain and discomfort associated with trigger points, spasms and other muscular ailments. Accordingly, in the event that a deltoid muscle of a user 12 is afflicted with pain or discomfort caused by a trigger point and/or muscle spasm, for example, the user 12 initially presses the massage ball 10 against the region adjacent to his or her shoulder 13 beneath which the afflicted muscle lies, using his or her hand 14. After about 5–7 seconds of continuous and steady pressure, the massage ball 10 gradually deforms about 1–3 cm to change shape and generally conform to the configuration of the surface on the shoulder 13 against which the massage ball 10 is pressed. Accordingly, the massage ball 10 applies pressure which penetrates the belly of the afflicted muscle without damaging the muscle tissue. As the massage ball 10 thus changes shape, the user 12 rolls the ball around on the affected area in a generally circular or back-and-forth motion while continuing to apply pressure against the massage ball 10 using the hand 14. This pressure applied to the affected area by the massage ball 10 increases flow of oxygenated blood or blood and oxygen to the muscle afflicted with the trigger point and/or spasms, creating elasticity in the belly of the muscle and relieving the associated pain and discomfort. This procedure is applied as often as is necessary to relieve the pain and discomfort and eliminate the condition. It will be appreciated by those skilled in the art that repeated use of the the massage ball 10 in the manner heretofore described is effective not only in relieving the pain and discomfort associated with trigger points, spasms or other muscular afflictions, but also in preventing additional occurances of the pain or discomfort. It will be further appreciated that the massage ball 10 provides a safe and effective way for a person to manipulate muscle or connective tissue on his or her own, without requiring the manual kneading action of a massage therapist.

An alternative manner of using the massage ball 10 is illustrated in FIG. 4, wherein the massage ball 10 is interposed between a hard surface 17, such as a floor, chair, wall, or other surface and an afflicted muscle in the lower abdominal or pelvic region 16 of a user 12. Accordingly, as the user 12 applies pressure against the massage ball 10, the massage ball 10 is stabilized against the affected region 16. The user 12 moves the affected area in a back-and-forth or circular motion against the massage ball 10 while continuing to apply pressure against the massage ball 10 until the pain and discomfort in the affected area 16 is relieved. It will be appreciated by those skilled in the art that the massage ball 10 may be used to massage any portion of the body, including but not limited to the pelvic region, back, shoulder, legs, arms, buttocks or sinus cavities, using the hard surface 17 in the manner heretofore described.

It is understood that numerous variations of the eight-layered message ball 10 as heretfore described are possible without departing from the scope of the invention. For example, the message ball may include the core 1, typically having a substantially solid material or multiple rubber bands tightly wound around each other, in addition to one or more elastic layers such as the inner elastic layer 3, one or more compressive layers such as the inner compressive layer 4, or one or more elastic layers in combination with one or more compressive layers, in addition to the ball cover 8. However, the optimum compression resistance (hardness), deformation characteristics and density, which preferably mirror those characteristics of the human thumb, are achieved by providing the core 1, the core cover 2, the inner elastic layer 3, the inner compressive layer 4, the middle elastic layer 5, the outer compressive layer 6, the outer elastic layer 7 and the ball cover 8, respectively, in the manner heretofore described with respect to FIGS. 1–2A.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above, I claim:

1. A massage ball comprising:

a substantially rigid core;

a substantially rigid plastic core cover encapsulating said core;

an inner elastic layer encapsulating said core cover;

an inner compressive layer encapsulating said inner elastic layer;

a middle elastic layer encapsulating said inner compressive layer;

an outer compressive layer encapsulating said middle elastic layer;

an outer elastic layer encapsulating said outer compressive layer;

a ball cover encapsulating said outer elastic layer;

wherein each of said inner elastic layer, said middle elastic layer and said outer elastic layer has a thickness of about 1 mm, said inner compressive layer has a thickness of about 6 mm and said outer compressive layer has a thickness of about 5 mm; and wherein said ball cover is a knit or fabric.

2. The massage ball of claim 1 further comprising a plurality of dimples provided in said core cover.

3. The massage ball of claim 1 wherein said inner elastic layer, said middle elastic layer and said outer elastic layer each comprises a non-woven material and a plurality of elastic fibers provided in said non-woven material and said inner compressive layer and said outer compressive layer each comprises an elastic bandage, and further comprising a plurality of dimples provided in said core cover.

* * * * *